US007509989B2

(12) United States Patent
Pham

(10) Patent No.: US 7,509,989 B2
(45) Date of Patent: Mar. 31, 2009

(54) WINDOW BLIND SYSTEM

(76) Inventor: Dung Viet Pham, 68 Rockwood Crescent, Thornhill, Ontario (CA) L4J 7T2

( * ) Notice: Subject to any disclaimer, the term of this patent is extended or adjusted under 35 U.S.C. 154(b) by 422 days.

(21) Appl. No.: 11/293,731

(22) Filed: Dec. 5, 2005

(65) Prior Publication Data

US 2007/0125503 A1 Jun. 7, 2007

(51) Int. Cl.
*E06B 3/32* (2006.01)

(52) U.S. Cl. ..... 160/87; 160/84.07; 160/84.04; 160/115

(58) Field of Classification Search ..... 160/84.04, 160/84.06, 84.07, 134, 87, 115, 117, 118, 160/33, 34, 123, 124, 371, 330
See application file for complete search history.

(56) References Cited

U.S. PATENT DOCUMENTS

| | | | | |
|---|---|---|---|---|
| 451,068 | A * | 4/1891 | Park | 160/84.07 |
| 1,499,678 | A * | 7/1924 | Maurer | 160/126 |
| 3,692,082 | A * | 9/1972 | Cromwell | 160/87 |
| 5,092,383 | A * | 3/1992 | Niemeijer et al. | 160/84.07 |
| 5,197,526 | A * | 3/1993 | Schon | 160/84.07 |
| 5,860,464 | A * | 1/1999 | Schon | 160/84.06 |
| 6,591,887 | B1 * | 7/2003 | Hsu | 160/84.03 |
| 7,261,137 | B2 * | 8/2007 | Dekker | 160/84.04 |
| 2006/0196614 | A1 * | 9/2006 | Strand et al. | 160/124 |

* cited by examiner

*Primary Examiner*—Blair M. Johnson
(74) *Attorney, Agent, or Firm*—David W. Wong

(57) ABSTRACT

A unique window blind system has two triangular panels. Each panel has a plurality of foldable sections bundled together at one fixed end and the remainder portion are unfoldable to cover a diagonally opposite triangular half portion of the window opening. The panels are mounted in the window frame in an inverted manner relative to one another with the fixed end adjacent to diagonally opposite corners of the window frame. Pull cords are provided for folding the sections in a fanfold manner to obtain selectively an opening covering partially or completely the window opening. Additional pull cords are provided for unfolding the sections of the two panels to cover selectively the window opening partially or completely from the opened state.

14 Claims, 7 Drawing Sheets

WINDOW BLIND SYSTEM

BACKGROUND OF THE INVENTION

1. Field of the Invention

This invention relates to window blinds and more particularly to a triangular window blind system which operates to cover or uncover the window opening diagonally.

2. Background Art

Heretofore, window blinds are either operative vertically or horizontally relative to a window frame. The blind consists normally of a plurality of slats linked together with cords such that they may be positioned juxtaposed to one another to cover over the window or to stack together to a vertical side or the upper horizontal side of the window so as to uncover the window. The blind may also be in the form of a pleated curtain having horizontal pleated folds which is hung over the window to cover the latter and which may be operated to fold into a compact horizontal stack at the upper side of the window for uncovering the window.

SUMMARY OF THE INVENTION

It is the principal object of the present invention to provide a unique window blind system having two triangular panels operative to open or close the view of the window diagonally of the window frame.

It is another object of the present invention to provide a window blind system having two pleated fan-shaped panels each having a side edge mounted to vertical rims of the window frame and a bundled end located at opposite diagonal corners of the window frame.

BRIEF DESCRIPTION OF THE DRAWINGS

The present invention is further described with reference to the accompanying drawings wherein.

DETAILED DESCRIPTION OF THE PREFERRED EMBODIMENTS

Figure 1:
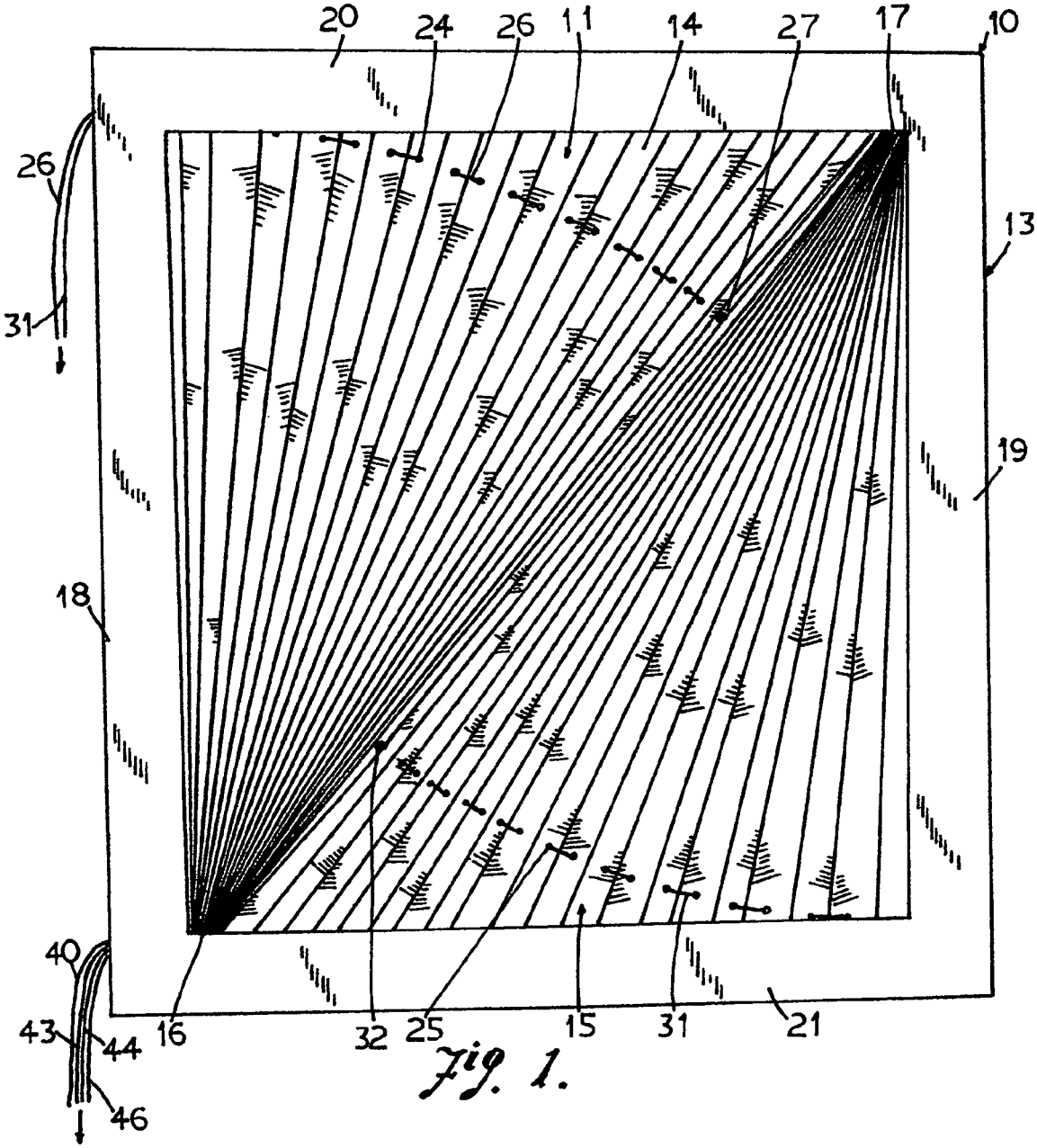
FIG. 1 is a perspective front elevation view of the window blind system according to the present invention with the triangular pleated panels expanded in the closed state covering over the window opening.

With reference to the drawings wherein like reference numerals designate corresponding parts in the several views, the window blind system 10 according to the present invention has two identical window blind panels 11 and 12 located within a window frame 13. Each of the panels has a plurality of sections, namely panel 11 comprises a plurality of sections 14 and panel 12 comprises a plurality of sections 15. The panels 11 and 12 may be made of a fabric material commonly used for making horizontal pleated window blinds having a plurality of sections formed in a vertically foldable manner. One edge of the panel 11 is fixedly bundled together to form a fixed end 16 and the remaining portion of the panel may be either folded by folding the plurality of sections 14 together in a fan-fold manner to form a stack or unfolded to form a substantially triangular panel. Similarly, one edge of the panel 12 is fixedly bundled together to form a fixed end 17 and the remaining portion of the panel may be either folded by folding the plurality of sections 15 together in a fan-fold manner to form a stack or unfolded to form a substantially triangular panel. The panels 11 and 12 are located within the window frame 13 in a inverted manner of one another with their fixed ends located at diagonally opposite corners of the window frame 13. As best shown in FIG. 1, the fixed end 16 of the left panel 11 is located at the left bottom corner of the window frame 13 and the fixed end 17 of the right panel 12 is located at the top right corner of the window frame 13. A rectangular window frame is shown as an exemplary embodiment. In the fully unfolded state, panel 11 and panel 12 will each cover a diagonally opposite half of the window opening as shown in FIG. 1 to cover the entire window opening.

The rectangular window frame 13 has a left side rim 18, a right side rim 19, a top side rim 20, and a bottom side rim 21. The outer left section 22 is secured to the left side rim 18, while the outer right section 23 is secured to the right side rim 19.

An opening 24 is formed in the top edge portion of the outer left section 22 of the panel 11, and a series of similar openings 24 are formed in the remaining sections. All openings 24 are located at an equal distance from the fixed end 16. Similarly, an opening 25 is formed in the bottom edge portion of the outer right section 23 of the panel 12, and a series of similar openings 25 are formed in the remaining sections. All openings 25 are located at an equal distance from the fixed end 17.

Figure 6:
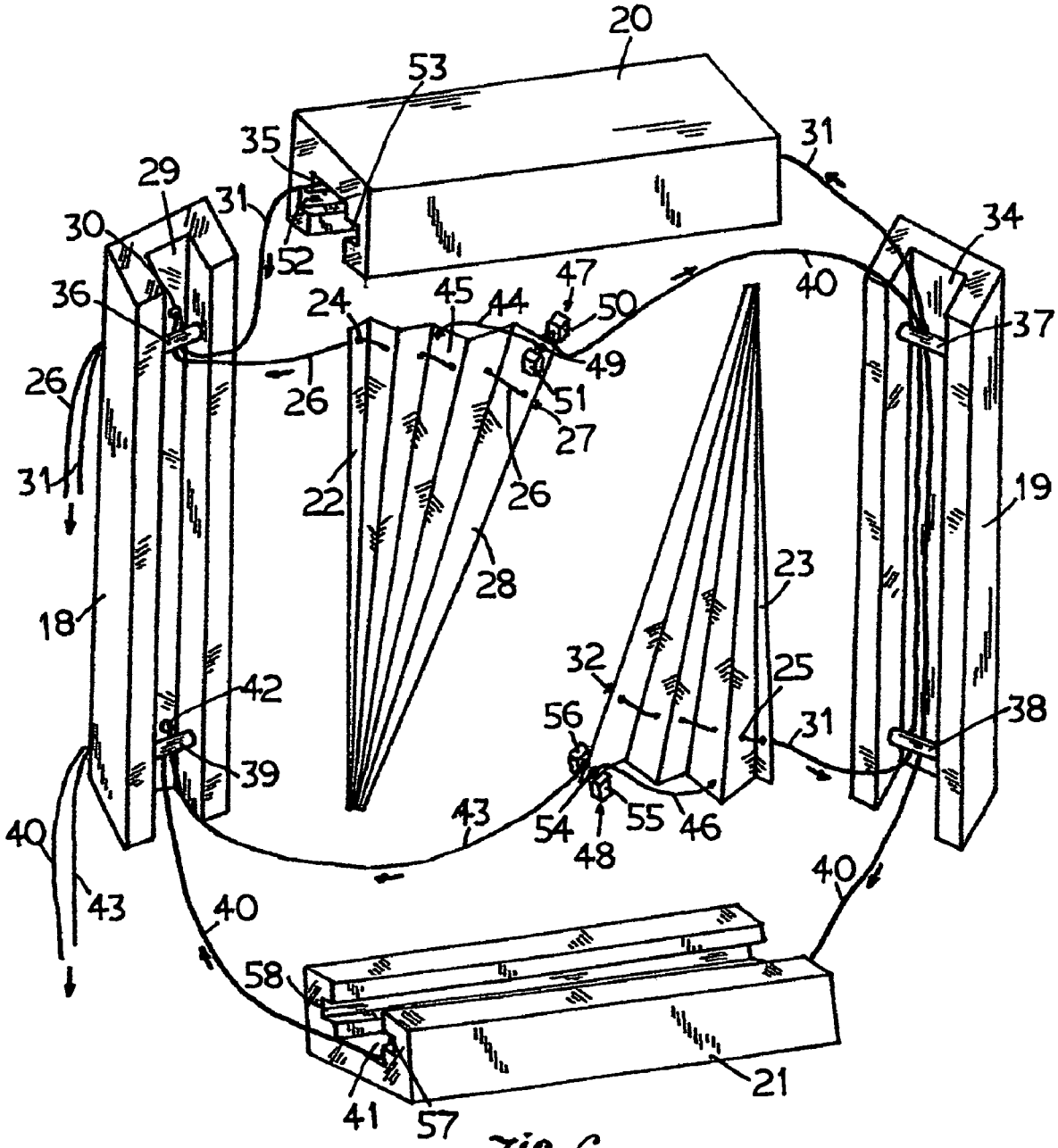
FIG. 6 is an exploded front elevation view of a second embodiment having sliders mounting the inner corners of the panels to the bottom side rim of the window frame.
Figure 7:
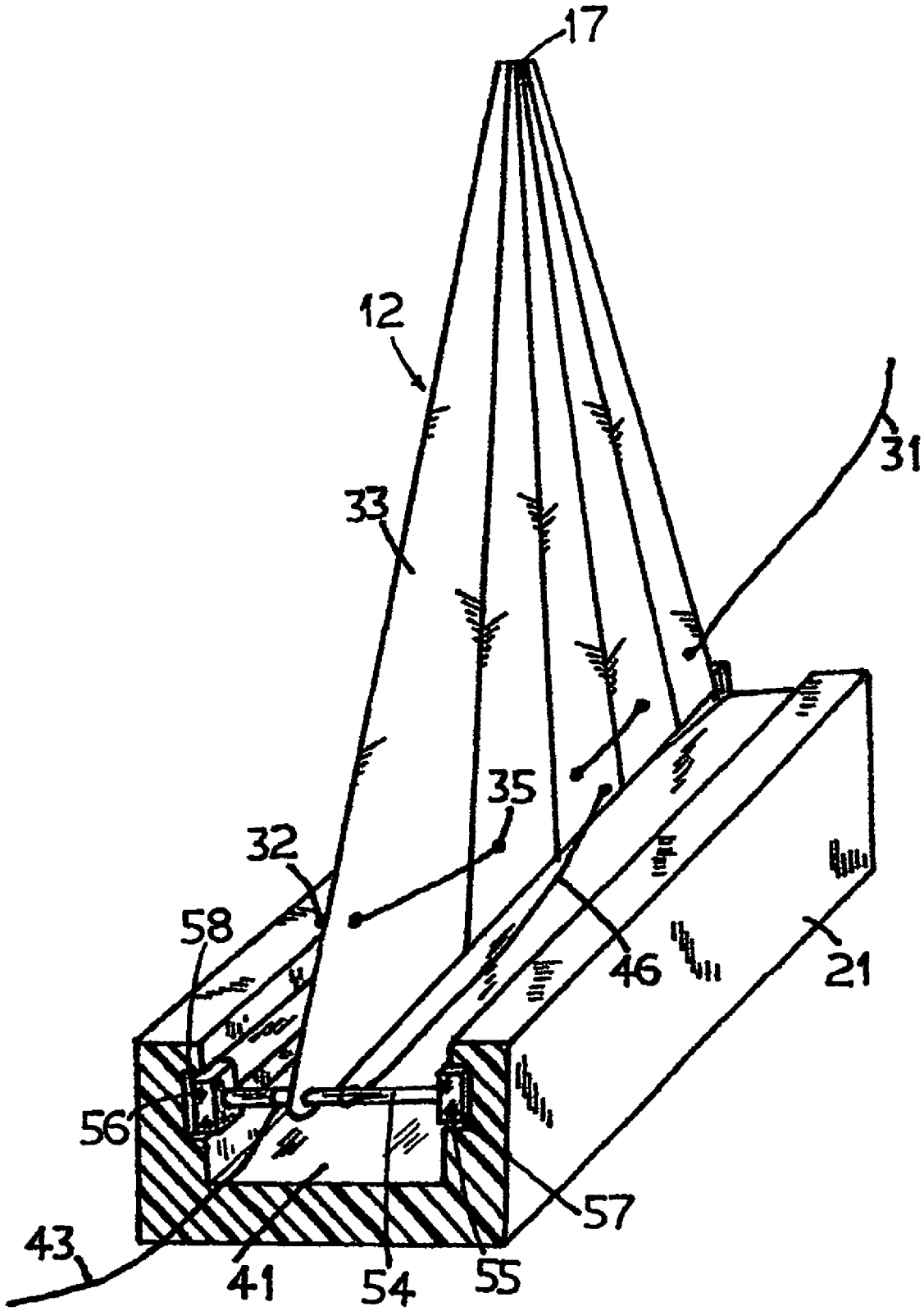
FIG. 7 is an isolated enlarged partial sectional side elevation view of the second embodiment showing the slidable mounting of the slider to the bottom side rim of the window frame.

An elongated first pull cord 26 is threaded through the openings 24 with an abutment knot 27 formed at its end juxtaposed to the inner section 28 of the left panel 11. The free end portion of the pull cord 26 is routed through a channel 29 to extend outside of the window frame 13 through an exit opening 30 formed in the left side rim 18. An elongated second pull cord 31 is threaded through the openings 25 of the panel 12 with an abutment knot 32 formed at its end juxtaposed to the inner section 33 of the panel 12. The free end portion of the pull cord 31 may be routed through a channel 34 in the right side rim 19, a channel 35 in the top side rim 20 and the channel 29 in the left side rim 18 to extend outside of the window frame 13 also through the exit opening 30. Guides such as rods 36 are transversely mounted in the channel 29 and located adjacent to the exit opening 30 to guide the pull cords 26 and 31 to extend through the exit opening 30 as well as maintaining the pull cords 26 and 31 in a taut state. A rotatable wheel 26A as shown in FIG. 6 may be rotatably mounted on the rods 36 to enhance the sliding movement of the pull cords 26 and 31 over the guides. Restraining rods 37 and 38 are also mounted in a transverse manner in the channel 34 of the right side rim 19 and an additional guide rod 39 is mounted in a transverse manner in channel 29 of the left side rim 18 for maintaining the pull cord 31 from routing neatly through the various channels as well as maintaining it in a taut state. A rotatable wheel similar to rotatable wheel 36A may also be rotatably mounted on guide rod 39 to enhance the movement of the pull cord 31.

An elongated first closing pull cord 40 is secured at one end to the top edge of the inner section 28 of the left panel 11. The free end portion of the first closing pull cord 40 may be routed through the channel 34 of the right side rim 19, the channel 41 formed in the bottom side rim 21, and the channel 30 of the left side rim 18 to extend outside of the window frame 13 through a second exit opening 42. Similarly, an elongated second closing pull cord 43 is secured at one end to the bottom edge corner of the inner section 33 of the right panel 12. The free end portion of the second closing pull cord 43 may be routed through the channel 41 of the bottom side rim 21 and the channel 30 of the left side rim 18 to extend outside the window frame 13 through the second exit opening 42.

Figure 2:
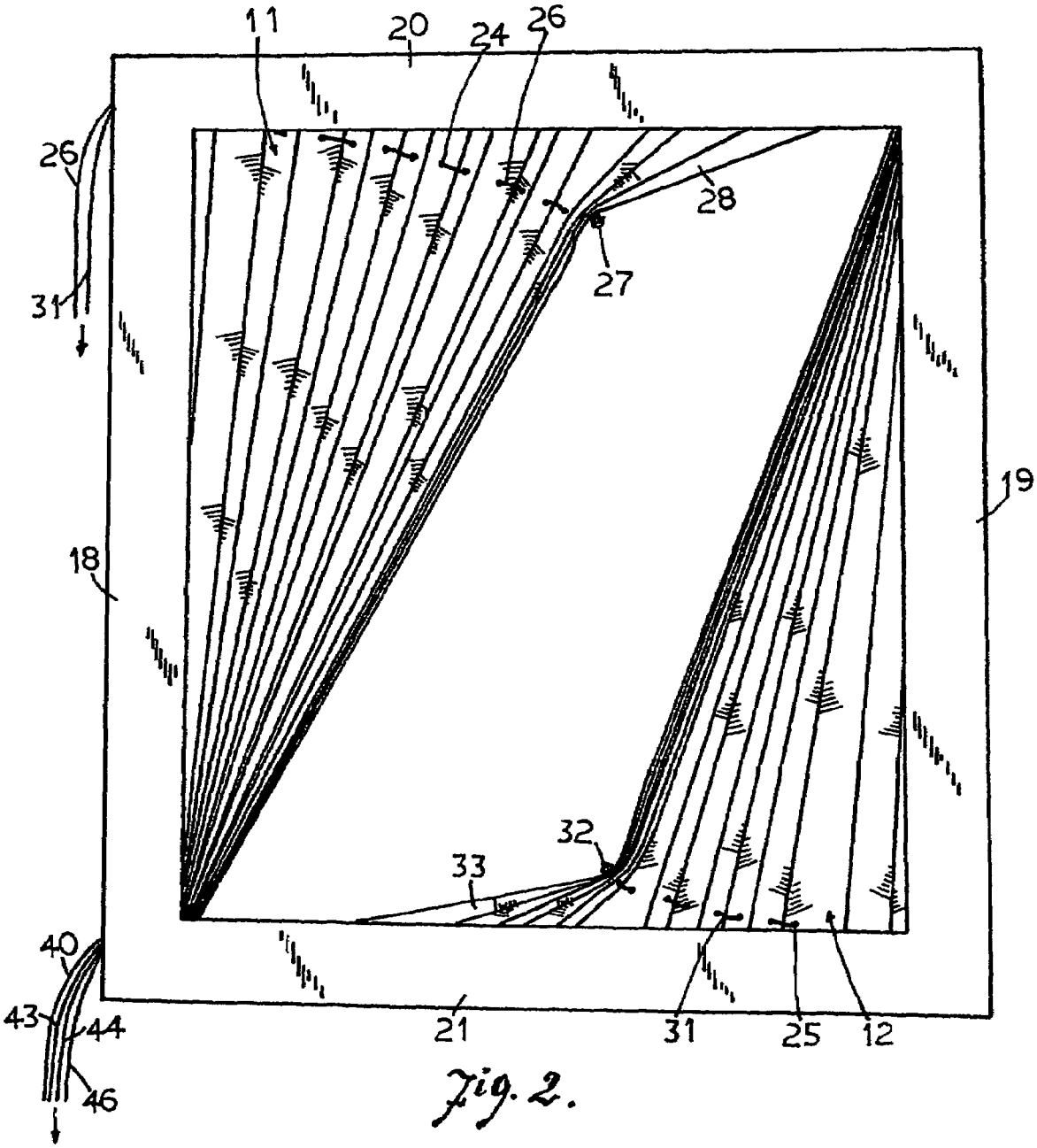
FIG. 2 is a perspective front elevation view of the window blind system with the pleated panels operated to a partially opened state.
Figure 3:
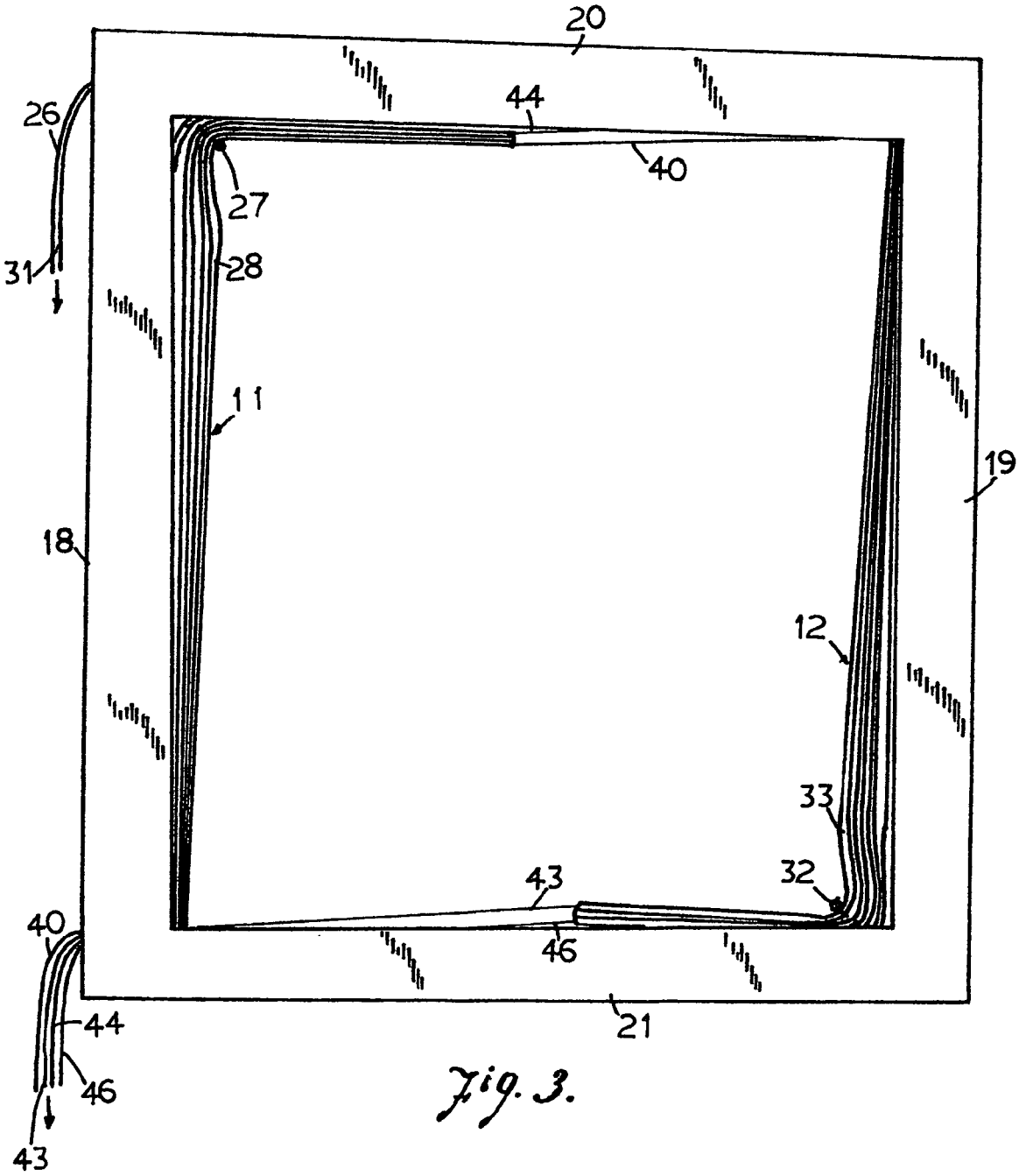
FIG. 3 is a perspective front elevation view of the window blind with the panels in a fully opened state.
Figure 4:
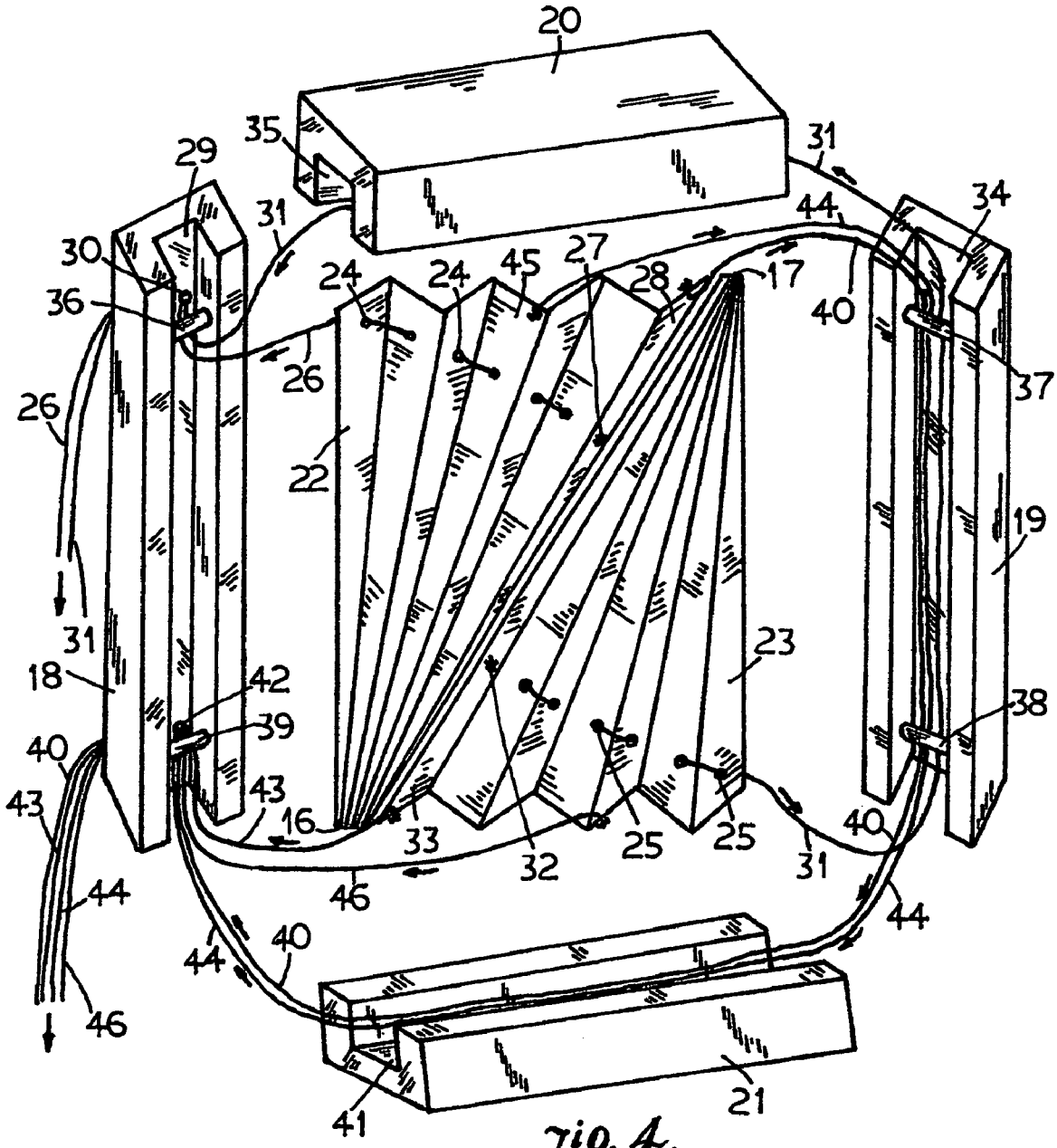
FIG. 4 is an exploded front elevation view of the window blind system showing the component parts therein. For simplicity of illustration, each panel of the window blind is shown to have seven foldable sections.
Figure 5:
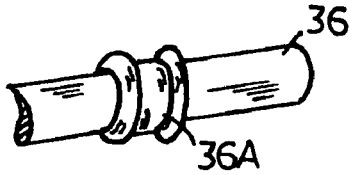
FIG. 5 is an isolated enlarged partial sectional view of guide rod having a rotatable wheel mounted thereon for enhancing the operation of the pull cord.

In operation, the panels 11 and 12 in the unfolded state completely covering the window opening may be partially opened to form a blind opening of a selected size having the unique oblique rectangular shape as best shown in FIG. 2 or to the completely opened state as shown in FIG. 3 by pulling the pull cords 26 and 31 downwards. This action causes the various sections of the panels 11 and 12 to fold in a fanfold manner in the opposite diagonal directions until they are all stacked in the folded state against the opposite side rims 18 and 19 in the completely opened state.

In the opened state, the panels 11 and 12 may be closed by pulling the closing pull cords 40 and 43 downwards such that they would pull the inner sections 28 and 33 towards one another to unfold the panels 11 and 12 in the diagonal direction to again form a selected size opening or completely covering the window opening with the inner edges of the inner sections 28 and 33 abutting one another.

The panels 11 and 12 preferably have a size such that the top edge portion of the panel 11 and the bottom edge portion of the panel 12 will extend within the channel 35 and channel 41 of the upper side rim 20 and the bottom side rim 21 respectively, when the panels 11 and 12 are in the unfolded state. Such construction, facilitates the panels 11 and 12 to completely covering the window opening without any gap between the panels and the top side rim 20 and the bottom side rim 21.

An additional elongated third closing pull cord 44 is secured at one end therein to the top edge of a middle section 45 of the left panel 11. The free end portion of the third closing pull cord 44 may be routed through the channel 34 of the right side rim 19, the channel 41 of the bottom side rim 21, and the channel 30 of the left side rim 18 to extend outside the window frame 13 also through the second exit opening 42. An additional elongated fourth closing pull cord 46 is secured at one end to the bottom edge portion of the middle section 47. The free end portion of the closing pull cord 46 may be routed through the channel 41 of the bottom side rim 21 and the channel 30 of the left side rim 18 to extend outside of the window frame 13 also through the second exit opening 42. The additional closing cords 44 and 46 may be operated together with the closing cords 40 and 43 simultaneously for enhancing the closing operation of the panels 11 and 12.

Figure 8:
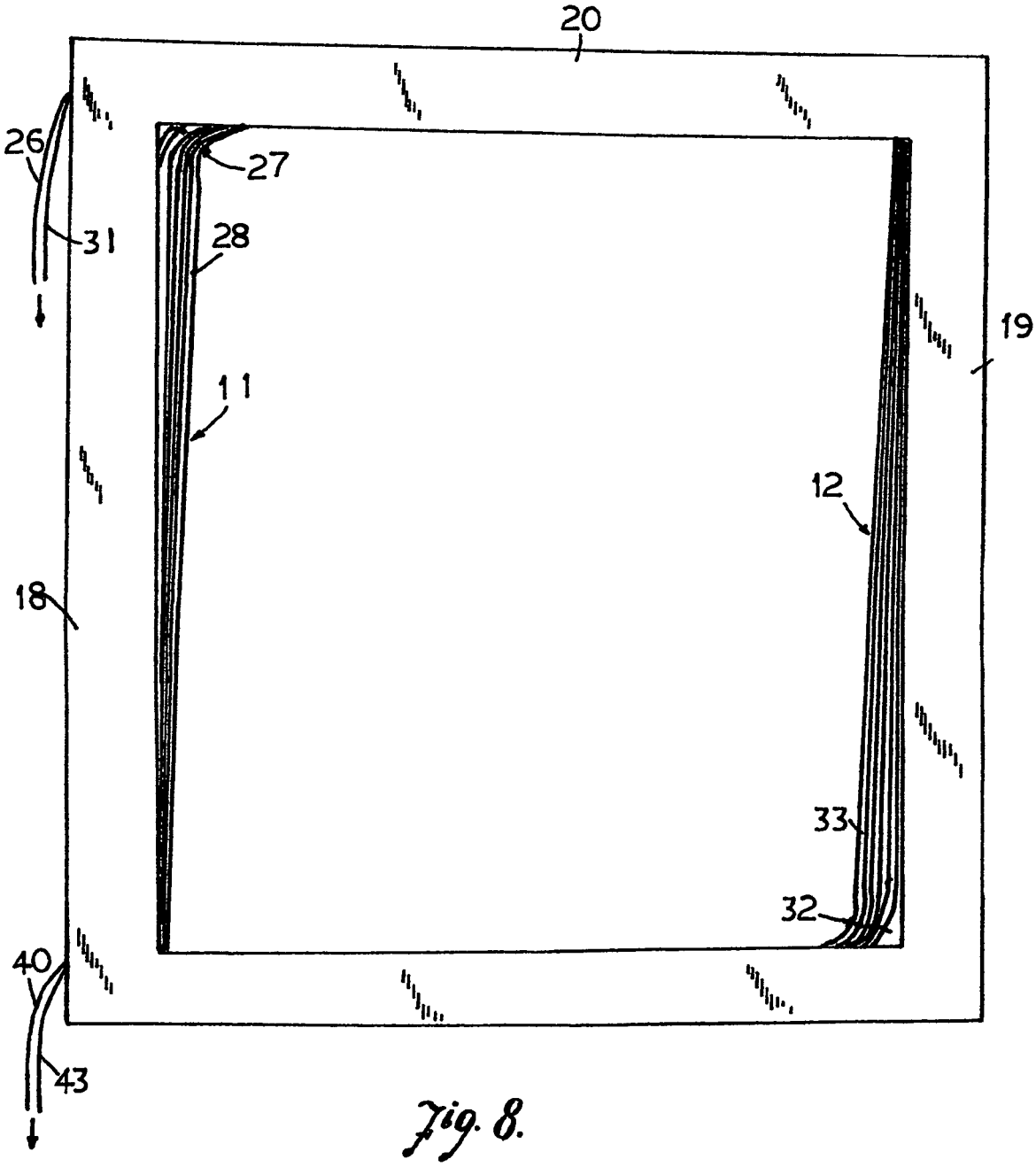
FIG. 8 is a perspective front elevation view of the window blind of the second embodiment in which the pull cords are retained and hidden within the channel in the bottom side rim of the window frame.

A bracket 47 may be mounted to the upper right corner of the inner section 28 of the left panel 11 at the opening 24 and a similar bracket 48 is mounted to the opening 25 at the bottom left corner of the inner section 33 of the right panel 12. The bracket 47 has a mounting rod 49 extending through the opening 24 and two slider blocks 50 and 51 are mounted on its two ends. The slider blocks 50 and 51 are slidably engageable with two side slots 52 and 53 respectively formed on the inner side walls of the channel 35 of the top side rim 20 of the window frame; similarly, the bracket 48 has a mounting rod 54 extending through the opening 25 of the inner section 28 and two slider blocks 55 and 56 are mounted on its two ends. The slider blocks 55 and 56 are slidably engageable with two side slots 57 and 58 respectively formed on the inner side walls of the channel 41 of the bottom side rim 21 of the window frame 10. In this embodiment, the pull 40 is tied to the mounting rod 49 of the bracket 47 instead of directly to the inner section 28 and the free end of the closing pull cord 44 is also tied to the bracket 47. Thus only the free end of the pull cord 40 is routed to the exit opening 42. Similarly, the pull cord 43 is tied to the mounting rod 54 of the bracket 48 with its free end routed to the exit opening 42, and the free end of the additional cord 46 is also tied to the transverse rod 54 of the bracket 48. In operation, only the two pull cords 40 and 43 will extend outside of the window frame and they may be pulled to drag the panels 11 and 12 towards each other for closing over the window opening. The brackets 47 and 48 will maintain the edge portions of the panel 11 and 12 within the channels 35 and 41 all the time such that at the opened state the portion of the pull cords 40 and 43 within the window frame will not be visible from the front of the window as best shown in FIG. 8.

While the present invention has been shown and described in the preferred embodiment thereof, it will be apparent that various modifications can be made therein without departing from the spirit or essential attributes thereof, and it is desired therefor that only such limitations be placed thereon as are imposed by the appended claims.

What is claimed is:

1. A window blind system for a window opening of a window frame comprising:

a left triangular panel and a right triangular panel, each of said left triangular panel and right triangular panel having a plurality of sections bundled fixedly at one fixed end, and said left triangular panel and right triangular panel being located in said window frame in an inverted manner relative to one another with said fixed end therein of each panel being located adjacent to a diagonally opposite corner of said window frame, an outer left side section of said left triangular panel secured to a left side rim of said window frame, and an outer right side section of said right triangular panel secured to a right side rim of said window frame, a first opening formed at an upper edge portion of said outer left section of said left triangular panel, and additional first openings formed at upper edge portion of all sections of said left triangular panel, said first opening and additional first openings being located at a substantially equal distance from said fixed end of said left triangular panel, a second opening formed at a bottom edge portion of said outer right section of said right triangular panel, and additional second openings formed at bottom edge portion of all sections of said right triangular panel, said second opening and additional second openings being located at a substantially equal distance from said fixed end of said right triangular panel, an elongated first pull cord threaded through said first opening and said additional first openings of said left triangular panel with an abutment knot formed therein juxtaposed to an inner section of said left triangular panel, said first pull cord having a free end portion extending outside said window frame through a first exit opening formed in one of said left side rim and right side rim, an elongated second pull cord threaded through said second opening and said additional second openings of said right triangular panel with an abutment knot formed therein juxtaposed to an inner section of said right triangular panel, said second pull cord having a free end extending outside of said window frame through said first exit opening, an elongated third pull cord having one end secured to a top corner of said inner section of said left triangular panel, and having a free end portion therein extending outside said window frame through a second exit opening, and an elongated fourth pull cord having one end secured to a bottom corner of said inner section of said right triangular panel, and having a free end portion therein extending outside said window frame through said second exit opening.

2. A window blind system according to claim 1 including an elongated fifth pull cord having one end therein secured to a top edge of a middle section of said left triangular panel and having a free end therein extending outside of said window frame through said second exit opening, and an elongated sixth pull cord having one end therein secured to a bottom edge of a middle section of said right triangular panel and having a free end therein extending outside of said window frame through said second exit opening.

3. A window blind system according to claim 2 wherein said left triangular panel and said right triangular panel are made of a fabric material having said plurality of sections therein formed in a fanfold manner.

4. A window blind system according to claim 3 wherein said first pull cord is routed to said first exit opening through a first channel formed in said left side rim, and said second pull cord is routed to said first exit opening through a second channel formed in said right side rim, a third channel formed in said top side rim and said first channel in said left side rim.

5. A window blind system according to claim 4 including a first guiding member mounted in said first channel and located adjacent said first exit opening, and operative for guiding said first pull cord and said second pull cord to extend through said first exit opening, and second guiding means mounted in said first channel and located adjacent said second opening and operative for guiding said third pull cord, said fourth pull cord, said fifth pull cord and said sixth pull cord to extend through said second exit opening.

6. A window blind system according to claim 5 including a first restraining member and a second restraining member mounted in said second channel of said right side rim and operative for guiding said second pull cord through said second channel and said third pull cord and said fourth pull cord through said second channel.

7. A window blind system according to claim 6 wherein said guiding member is a rod mounted in a transverse manner in said first channel, and said first restraining member and said second restraining member are rods mounted in a transverse manner in said second channel.

8. A window blind system according to claim 7 including a rotatable wheel rotatably mounted on said first guiding member and said second guide member for enhancing movement of all pull cords to extend through said first exit opening and said second exit opening.

9. A window blind system according to claim 8 wherein said left triangular panel has an upper edge portion extending within said third channel of said top side rim and said right triangular panel has a bottom edge portion extending within a fourth channel formed in said bottom side rim.

10. A window blind system for a window opening of a window frame comprising:

a left triangular panel and a right triangular panel, each of said left triangular panel and said right triangular panel having a plurality of sections bundled fixedly at one fixed end, and said left triangular panel and right triangular panel being located in said window frame in an inverted manner relative to one another with said fixed end therein of each panel being located adjacent to a diagonally opposite corner of said window frame, an outer left side section of said left triangular panel secured to a left side rim of said window frame, and an outer right side section of said right triangular panel secured to a right side rim of said window frame, a first opening formed at an upper edge portion of said outer left section of said left triangular panel, and additional first openings formed at upper edge portion of all other sections of said left triangular panels, said first opening and said additional first openings being located at a substantially equal distance from said fixed end of said left triangular panel, a second opening formed at a bottom edge portion of said outer right section of said right triangular panel, and additional second openings formed at bottom edge portion of all other sections of said right triangular panel, said second opening and said additional second openings being located at a substantially equal distance from said fixed end of said right triangular panel, an elongated first pull cord threaded through said first opening and said additional first openings of said left triangular panel with an abutment knot formed therein juxtaposed to an inner section of said left triangular panel, said first pull cord having a free end portion extending outside of said window frame through a first exit opening formed in one of said left side rim and right side rim, an elongated second pull cord threaded through said second opening and said additional second openings of said right triangular panel with an abutment knot formed therein juxtaposed to an inner section of said right triangular panel, said second pull cord having a free end extending outside of said window frame through said first exit opening, a first bracket mounted to a top corner of said inner section of said left triangular panel, said first bracket having two slider blocks located on two opposite sides of said inner section of said left triangular panel, said slider blocks being slidably engageable with two elongated slots formed on inner side walls of a first channel formed in a top rim of said window frame, an elongated third pull cord having one end therein tied to said first bracket and a free end extending outside said window frame through a second exit opening formed in a vertical side run of said window frame, a second bracket mounted to a bottom corner of said inner section of said right triangular panel, said second bracket having two slider blocks located on two opposite sides of said inner section of said right triangular panel, said slider blocks being slidably engageable with two additional elongated slots formed on inner side walls of a second channel formed in a bottom rim of said window frame, an elongated fourth pull cord having one end therein tied to said second bracket and a free end extending outside said window frame through said second exit opening.

11. A window blind system according to claim 10 including a first connecting cord having one end therein tied to an upper edge portion of a middle section of said left triangular panel and a second end therein tied to said first bracket, a second connecting cord having one end therein tied to a lower edge portion of a middle section of said right triangular panel and a second end therein tied to said second bracket.

12. A window blind system according to claim 11 including a first guide member mounted in a channel in said vertical side rim and located adjacent to said first exit opening and adapted for guiding said first pull cord and said second pull cord from extending through said first exit opening, and a second guide member mounted said channel and located adjacent to said second exit opening and adapted for guiding said third pull cord and said fourth pull cord from extending through said second exit opening.

13. A window blind system according to claim 12 wherein said first guide member is a first rod mounted in a transverse manner in said channel of said vertical side rim, said second guide member is a second rod mounted in a transverse manner in said channel.

14. A window blind system according to claim 13 including a rotatable wheel mounted on said first rod and adapted to enhance movement of said first pull cord and said second pull cord from extending through said first exit opening, a second rotatable wheel mounted on said second rod and adapted to enhance movement of said third pull cord and said fourth pull cord to extend through said second exit opening.

* * * * *